US008831494B2

(12) United States Patent
Ikebuchi et al.

(10) Patent No.: US 8,831,494 B2
(45) Date of Patent: Sep. 9, 2014

(54) FIXING DEVICE AND IMAGE FORMING APPARATUS INCLUDING SAME

(75) Inventors: Yutaka Ikebuchi, Kanagawa-ken (JP); Hiroshi Yoshinaga, Chiba-ken (JP); Toshihiko Shimokawa, Kanagawa-ken (JP); Masaaki Yoshikawa, Tokyo (JP); Yoshiki Yamaguchi, Kanagawa-ken (JP); Naoki Iwaya, Tokyo (JP); Tetsuo Tokuda, Kanagawa-ken (JP); Kenji Ishii, Kanagawa-ken (JP); Ippei Fujimoto, Kanagawa-ken (JP); Shuntaroh Tamaki, Kanagawa-ken (JP); Akira Shinshi, Tokyo (JP); Takahiro Imada, Kanagawa-ken (JP); Takamasa Hase, Kanagawa-ken (JP); Kenichi Hasegawa, Kanagawa-ken (JP)

(73) Assignee: Ricoh Company Limited, Tokyo (JP)

( * ) Notice: Subject to any disclaimer, the term of this patent is extended or adjusted under 35 U.S.C. 154(b) by 648 days.

(21) Appl. No.: 13/027,533

(22) Filed: Feb. 15, 2011

(65) Prior Publication Data

US 2011/0200370 A1 Aug. 18, 2011

(30) Foreign Application Priority Data

Feb. 17, 2010 (JP) ..... 2010-031986

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS

| | | | |
|---|---|---|---|
| 7,869,753 | B2 | 1/2011 | Shinshi |
| 2007/0292175 | A1 | 12/2007 | Shinshi |
| 2008/0112739 | A1 | 5/2008 | Shinshi |
| 2008/0175633 | A1 | 7/2008 | Shinshi |

(Continued)

FOREIGN PATENT DOCUMENTS

| | | | |
|---|---|---|---|
| CN | 101609293 | A | 12/2009 |
| JP | 2007-334205 | | 12/2007 |
| JP | 2008-158482 | | 7/2008 |

OTHER PUBLICATIONS

U.S. Appl. No. 12/805,818, filed Aug. 20, 2010.

(Continued)

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

A fixing device includes a substantially cylindrical metal member, a heater positioned to heat the metal member, an endless, flexible fixing member disposed rotatably around the metal member and heated by the metal member to heat and fix a toner image, a rotary pressing member disposed opposite the metal member and pressed against an outer circumferential surface of the fixing member to form a nip therebetween, and a stationary member disposed at an inner circumferential surface side of the fixing member and pressed by the pressing member via the fixing member to form the nip. At least when the fixing member is relatively moved toward the metal member during assembly of the fixing member with the metal member, the metal member includes at least one protruding portion protruding axially outward from an axial end of the metal member to guide the fixing member axially toward the metal member.

11 Claims, 7 Drawing Sheets

(56) References Cited

U.S. PATENT DOCUMENTS

| | | | | |
|---|---|---|---|---|
| 2008/0298862 | A1 | 12/2008 | Shinshi | |
| 2009/0311016 | A1 | 12/2009 | Shinshi | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026987 | A1 | 2/2011 | Hasegawa | |
| 2011/0026988 | A1* | 2/2011 | Yoshikawa et al. | 399/329 |

OTHER PUBLICATIONS

U.S. Appl. No. 12/876,589, filed Sep. 7, 2010, Yoshiki Yamaguchi et al.
U.S. Appl. No. 12/879,875, filed Sep. 10, 2010, Ippei Fujimoto et al.
U.S. Appl. No. 12/852,079, filed Aug. 6, 2010, Akira Shinshi et al.
U.S. Appl. No. 12/923,272, filed Sep. 13, 2010.
U.S. Appl. No. 12/881,862, filed Sep. 14, 2010, Takamasa Hase et al.
U.S. Appl. No. 12/888,980, filed Sep. 23, 2010, Yoshiki Yamaguchi et al.
U.S. Appl. No. 12/923,231, filed Sep. 10, 2010.
U.S. Appl. No. 12/923,176, filed Sep. 8, 2010.
U.S. Appl. No. 12/874,734, filed Sep. 2, 2010, Akira Shinshi et al.
U.S. Appl. No. 12/861,255, filed Aug. 23, 2010, Satoshi Ueno et al.
U.S. Appl. No. 12/881,547, filed Sep. 14, 2010, Naoki Iwaya et al.
U.S. Appl. No. 12/849,404, filed Aug. 3, 2010, Toshihiko Shimokawa et al.
U.S. Appl. No. 12/878,480, filed Sep. 9, 2010, Yoshiki Yamaguchi et al.
U.S. Appl. No. 12/880,327, filed Sep. 13, 2010, Ryota Yamashina et al.
U.S. Appl. No. 12/857,953, filed Aug. 17, 2010, Masaaki Yoshikawa et al.
U.S. Appl. No. 12/893,361, filed Sep. 29, 2010, Kenichi Hasegawa et al.
U.S. Appl. No. 12/878,557 filed Sep. 9, 2010, Akira Shinshi et al.
U.S. Appl. No. 12/946,276, filed Nov. 15, 2010, Yoshiki Yamaguchi et al.
U.S. Appl. No. 12/946,347, filed Nov. 15, 2010, Kenji Ishii et al.

* cited by examiner

FIXING DEVICE AND IMAGE FORMING APPARATUS INCLUDING SAME

CROSS-REFERENCE TO RELATED APPLICATIONS

The present patent application claims priority pursuant to 35 U.S.C. §119 from Japanese Patent Application No. 2010-031986, filed on Feb. 17, 2010 in the Japan Patent Office, which is incorporated herein by reference in its entirety.

BACKGROUND

1. Field

Exemplary embodiments of the present disclosure relate to an image forming apparatus, such as a copier, a printer, a facsimile machine, or a multifunctional device having at least two of the foregoing capabilities, and a fixing device employed in the image forming apparatus.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such a fixing device may include a cylindrical metal member to heat the fixing device effectively to shorten a warm-up time or a time to first print (hereinafter also "first print time"). Specifically, the metal member provided inside a loop into which an endless fixing belt is formed, facing the inner circumferential surface of the fixing belt. The metal member is heated by a built-in or external heater so as to heat the fixing belt. A pressing roller presses against the outer circumferential surface of the fixing belt at a position corresponding to the location of the metal member inside the loop formed by the fixing belt to form a nip between the fixing belt and the pressing roller through which the recording medium bearing the toner image passes. As the recording medium bearing the toner image passes through the nip, the fixing belt and the pressing roller apply heat and pressure to the recording medium to fix the toner image on the recording medium.

For example, for a fixing device like that described in JP-2008-158482-A has an advantage of preventing faulty fixing even when the warm-up time and/or first print time are shortened to speed up the fixing process. However, for the fixing device, each of the cylindrical metal member and the fixing belt is thin, and the clearance between the metal member and the fixing belt is 1 mm or smaller, resulting in a low operability when the fixing belt is relatively moved toward the metal member in the axial direction of the fixing belt for assembly.

SUMMARY

In an aspect of this disclosure, there is provided an improved fixing device including a substantially cylindrical metal member, a heater, an endless, flexible fixing member, a rotary pressing member, and a stationary member. The heater is positioned to heat the metal member. The fixing member is disposed rotatably around the metal member. An inner circumferential surface of the fixing member is heated by the metal member to heat and fix a toner image. The rotary pressing member is disposed opposite the metal member and pressed against an outer circumferential surface of the fixing member to form a nip between the rotary pressing member and the fixing member through which a recording medium bearing the toner image passes. The stationary member is disposed at an inner circumferential surface side of the fixing member and pressed by the rotary pressing member via the fixing member to form the nip. At least when the fixing member is relatively moved toward the metal member during assembly of the fixing member with the metal member, the metal member includes at least one protruding portion protruding axially outward from an axial end of the metal member to guide the fixing member axially toward the metal member.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
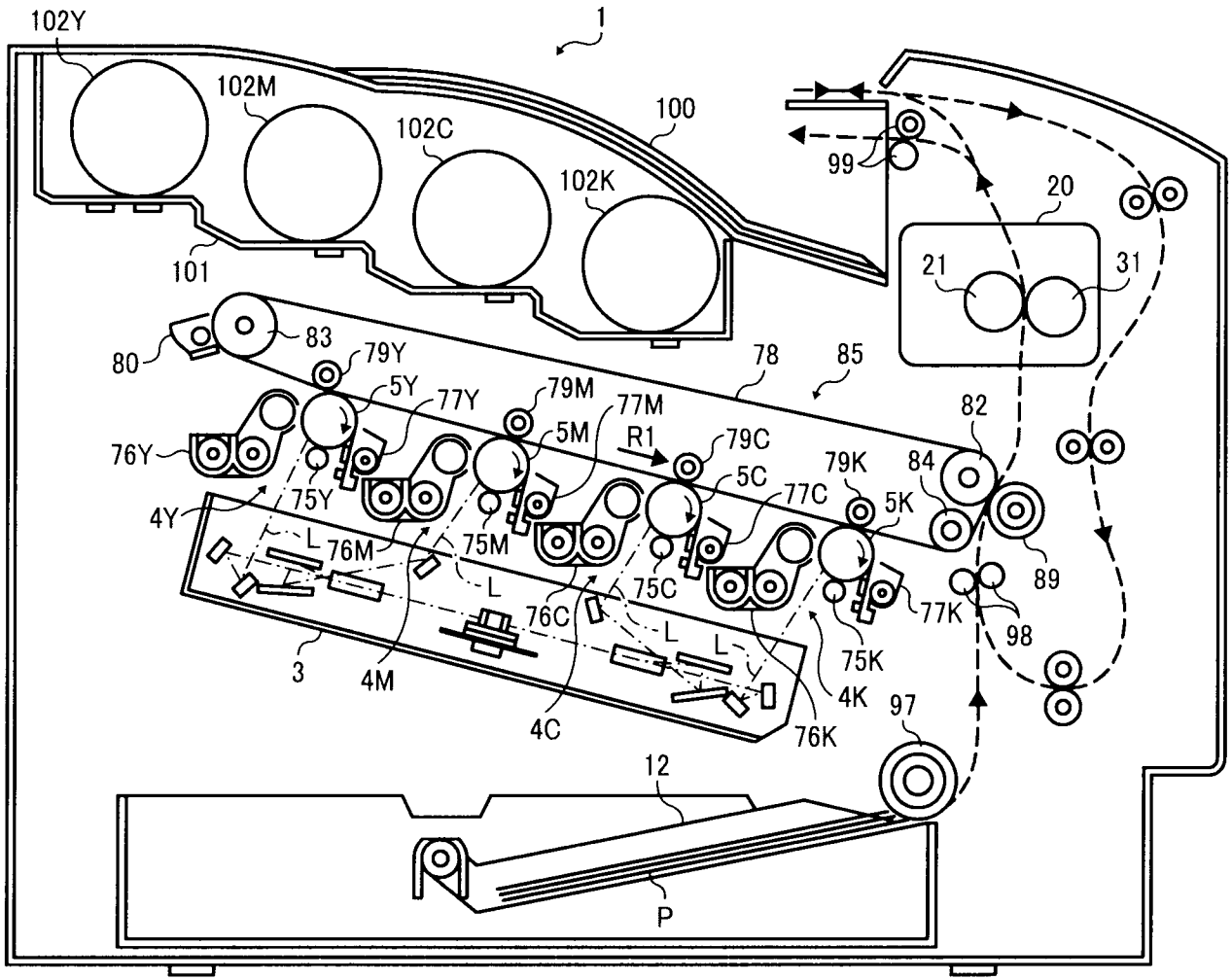
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, in particular to FIG. 1, an image forming apparatus 1 according to an exemplary embodiment of the present disclosure is described.

First, configuration and operation of the image forming apparatus 1 are described with reference to FIG. 1.

In FIG. 1, the image forming apparatus 1 is a tandem color printer for forming a color image on a recording medium. However, it is to be noted that the image forming apparatus may be any other suitable type of image forming apparatus, such as a copier, a facsimile machine, a printer, or a multifunction printer having at least one of copying, printing, scanning, plotter, and facsimile functions.

A toner bottle holder 1 is provided in an upper portion of the image forming apparatus 1. Four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

An intermediate transfer unit 85 is provided below the toner bottle holder 101. Image forming devices 4Y, 4M, 4C, and 4K are arranged opposite an intermediate transfer belt 78 of the intermediate transfer unit 85, and form yellow, magenta, cyan, and black toner images, respectively.

The image forming devices 4Y, 4M, 4C, and 4K include photoconductive drums 5Y, 5M, 5C, and 5K, respectively. Further, chargers 75Y, 75M, 75C, and 75K, development devices 76Y, 76M, 76C, and 76K, cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, an exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

Accordingly, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The intermediate transfer unit 85 includes the intermediate transfer belt 78, the first transfer bias rollers 79Y, 79M, 79C, and 79K, an intermediate transfer cleaner 80, a second transfer backup roller 82, a cleaning backup roller 83, and a tension roller 84. The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The color toner image formed on the intermediate transfer belt 78 reaches the second transfer nip. At the second transfer nip, a second transfer roller 89 and the second transfer backup roller 82 sandwich the intermediate transfer belt 78. The second transfer roller 89 transfers the color toner image formed on the intermediate transfer belt 78 onto the recording medium P fed by a registration roller pair 98 at the second transfer nip formed between the second transfer roller 89 and the intermediate transfer belt 78. After the transfer of the color toner image, residual toner, which has not been transferred onto the recording medium P, remains on the intermediate transfer belt 78.

Then, the intermediate transfer belt 78 reaches the position of the intermediate transfer cleaner 80. The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

A paper tray 12 is provided in a lower portion of the image forming apparatus 1, and loads a plurality of recording media P (e.g., transfer sheets). A feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip. Thus, a color toner image is formed on the recording medium P.

The recording medium P bearing the color toner image is sent to a fixing device 20. In the fixing device 20, a fixing belt 21 and a pressing roller 31 apply heat and pressure to the recording medium P to fix the color toner image on the recording medium P. An output roller pair 99 discharges the recording medium P to an outside of the image forming apparatus 1, that is, a stack portion 100. Thus, the recording media P discharged by the output roller pair 99 are stacked on the stack portion 100 successively to complete a single sequence of image forming processes performed by the image forming apparatus 1.

Referring to FIGS. 2 to 6, the following describes the structure and operation of the fixing device 20.

Figure 2:
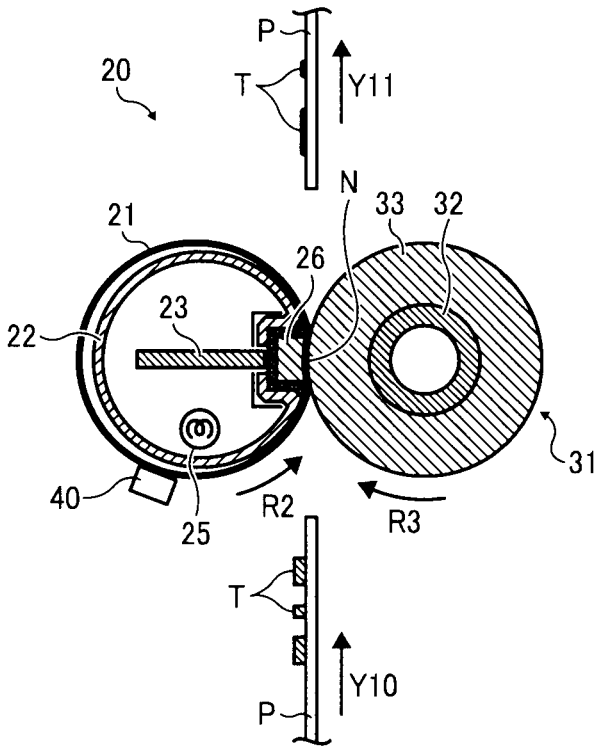
FIG. 2 is a sectional view of a fixing device of the image forming apparatus shown in FIG. 1.
Figure 3:
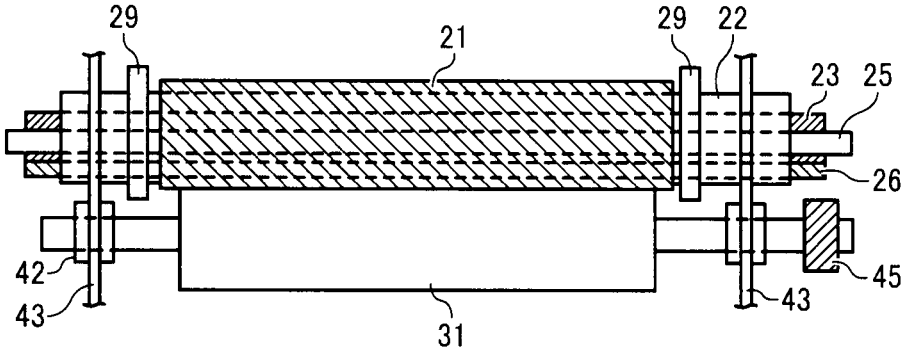
FIG. 3 is a plan view of the fixing device of FIG. 2 in an axial direction thereof.
Figure 4:
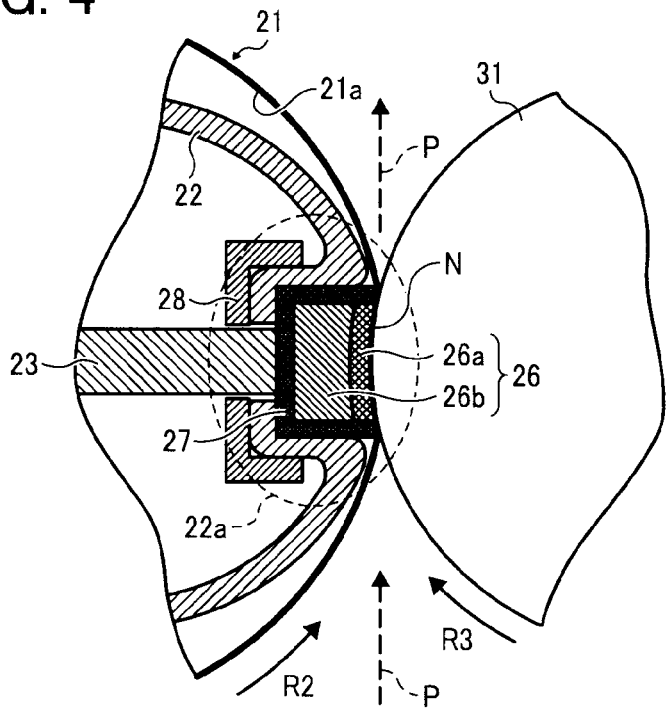
FIG. 4 is an enlarged view of a nip and its neighboring area of the fixing device of FIG. 2.

As illustrated in FIGS. 2 to 4, the fixing device 20 includes the fixing belt 21 serving as a fixing member or a belt member, a stationary member 26, a metal member 22 serving as a heating member, a reinforcement member 23, a heater 25 serving as a heat source, the pressing roller 31 serving as a rotary pressing member, a temperature sensor 40, a heat insulator 27, and a stay 28.

The fixing belt 21 may be a thin, flexible endless belt that rotates or moves counterclockwise in FIG. 2, i.e., in a rotation direction R2 indicated by an arrow in FIG. 2. The fixing belt 21 is constructed of a base layer, an intermediate elastic layer, and a surface release layer, and has a total thickness not greater than approximately 1 mm. The base layer includes an inner circumferential surface 21*a* serving as a sliding surface which slides over the stationary member 26. The elastic layer is provided on the base layer. The release layer is provided on the elastic layer.

The base layer of the fixing belt 21 has a thickness in a range of from approximately 30 μm to approximately 50 μm, and includes a metal material such as nickel and/or stainless steel, and/or a resin material such as polyimide.

The elastic layer of the fixing belt 21 has a thickness in a range of from approximately 100 μm to approximately 300 μm, and includes a rubber material such as silicon rubber, silicon rubber foam, and/or fluorocarbon rubber. The elastic layer eliminates or reduces slight surface asperities of the fixing belt 21 at a nip N formed between the fixing belt 21 and the pressing roller 31. Accordingly, heat is uniformly transmitted from the fixing belt 21 to a toner image T on a recording medium P, suppressing formation of a rough image such as an orange peel image.

In this exemplary embodiment, the elastic layer of the fixing belt 21 is made of, for example, silicone rubber of a thickness of approximately 200 μm.

The release layer of the fixing belt 21 has a thickness in a range of from approximately 10 μm to approximately 50 μm, and includes tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The diameter of the fixing belt 21 is set to approximately 15 mm to approximately 120 mm. In this exemplary embodiment, the fixing belt 21 has an inner diameter of, for example, approximately 30 mm. As illustrated in FIGS. 2 to 4, the stationary member 26, the heater 25, the metal member 22, the reinforcement member 23, the heat insulator 27, and the stay 28 are fixedly provided inside a loop formed by the fixing belt 21. In other words, the stationary member 26, the heater 25, the metal member 22, the reinforcement member 23, the heat insulator 27, and the stay 28 do not face an outer circumferential surface of the fixing belt 21, but face the inner circumferential surface 21*a* of the fixing belt 21. A lubricant intervenes between the fixing belt 21 and the metal member 22.

The stationary member 26 is fixed inside the fixing belt 21 in such a manner that the inner circumferential surface 21*a* of the fixing belt 21 slides over the stationary member 26. The stationary member 26 is pressed by the pressing roller 31 with the fixing belt 21 sandwiched between the stationary member 26 and the pressing roller 31 to form the nip N between the fixing belt 21 and the pressing roller 31 through which the recording medium P is conveyed. As illustrated in FIG. 3, both ends of the stationary member 26 in a width direction of the stationary member 26 parallel to an axial direction of the fixing belt 21 are mounted on and supported by the side plates 43 of the fixing device 20, respectively. The configuration of the stationary member 26 is described in more detail below.

As illustrated in FIG. 2, the metal member 22 has a substantially cylindrical shape. The metal member 22 serving as a heating member directly faces the inner circumferential surface 21*a* of the fixing belt 21 at a position other than the nip N. At the nip N, the metal member 22 holds the stationary member 26 via the heat insulator 27. As illustrated in FIG. 3, both ends of the metal member 22 in an axial direction of the metal member 22 parallel to the axial direction of the fixing belt 21 are mounted on and supported by the side plates 43 of the fixing device 20, respectively. The flanges 29 are provided on both ends of the metal member 22 in the axial direction of the metal member 22 to restrict movement (e.g., shifting) of the fixing belt 21 in the axial direction of the fixing belt 21.

The substantially-cylindrical metal member 22 heated by radiation heat generated by the heater 25 heats (e.g., transmits heat to) the fixing belt 21. In other words, the heater 25 heats the metal member 22 directly and heats the fixing belt 21 indirectly via the metal member 22. The metal member 22 may have a thickness not greater than approximately 0.1 mm to maintain desired heating efficiency for heating the fixing belt 21.

The metal member 22 may include a metal thermal conductor, that is, a metal having thermal conductivity, such as stainless steel, nickel, aluminum, and/or iron. Preferably, the metal member 22 may include ferrite stainless steel having a relatively smaller heat capacity per unit volume obtained by multiplying density by specific heat. In this exemplary embodiment, the metal member 22 includes, for example, SUS430 stainless steel as ferrite stainless steel and has a thickness of, for example, 0.1 mm.

The heater 25 may be a halogen heater and/or a carbon heater. As illustrated in FIG. 3, both ends of the heater 25 in a width direction of the heater 25 parallel to the axial direction of the fixing belt 21 are fixedly mounted on the side plates 43 of the fixing device 20, respectively. Radiation heat generated by the heater 25, which is controlled by a power source provided in the image forming apparatus 1 illustrated in FIG. 1, heats the metal member 22. The metal member 22 heats substantially the entire fixing belt 21. In other words, the metal member 22 heats a portion of the fixing belt 21 other than the nip N. Heat is transmitted from the heated outer circumferential surface of the fixing belt 21 to the toner image T on the recording medium P. As illustrated in FIG. 2, the temperature sensor 40, which may be a thermistor, faces the outer circumferential surface of the fixing belt 21 to detect a temperature of the outer circumferential surface of the fixing belt 21. A controller controls the heater 25 according to detection results provided by the temperature sensor 40 so as to adjust the temperature (e.g., fixing temperature) of the fixing belt 21 to a desired temperature.

As described above, for the fixing device 20 according to this exemplary embodiment, the metal member 1 does not heat a small part of the fixing belt 21 but heats substantially the entire fixing belt 21 in a circumferential direction of the fixing belt 21. Accordingly, even when the image forming apparatus 1 illustrated in FIG. 1 forms a toner image at high speed, the fixing belt 21 is heated enough to suppress fixing failure. In other words, the relatively simple structure of the fixing device 20 heats the fixing belt 21 efficiently, resulting in a shortened warm-up time, a shortened first print time, and the downsized image forming apparatus 1.

The substantially-cylindrical metal member 22 is disposed opposite the fixing belt 21 in such a manner that a certain clearance is provided between the inner circumferential surface 21*a* of the fixing belt 21 and the metal member 22 over an area along the inner surface of the fixing belt 21 except for where the nip N is formed. The clearance 5, that is, a gap between the fixing belt 21 and the metal member 22 at the area along the inner surface of the fixing belt 21 other than the nip N, is not greater than 1 mm, expressed as $0\ \text{mm}<\delta=<1\ \text{mm}$. Accordingly, the fixing belt 21 does not slidably contact the metal member 22 over an increased area, thus suppressing wearing of the fixing belt 21. At the same time, the clearance provided between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21.

In this exemplary embodiment, as illustrated in FIG. 5, a protruding portion 22*b* is provided at an axial end of the metal member 22, thus facilitating assembly of the fixing belt 21 with the metal member 22.

A lubricant, such as fluorine grease or silicone oil, is applied between the inner circumferential surface 21*a* of the fixing belt 21 and the metal member 22, so as to decrease wearing of the fixing belt 21 as the fixing belt 21 slidably contacts the metal member 22.

In this exemplary embodiment, the metal member 22 has a cross section of a substantially circular shape. Alternatively, the metal member 22 may have a cross section of a polygonal shape.

As illustrated in FIG. 2, the reinforcement member 23 reinforces the stationary member 26 which forms the nip N between the fixing belt 21 and the pressing roller 31. The reinforcement member 23 is fixedly provided inside the loop formed by the fixing belt 21 and faces the inner circumferential surface 21*a* of the fixing belt 21. As illustrated in FIG. 3, a width of the reinforcement member 23 in a width direction of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly mounted on the side plates 43 of the fixing device 20, respectively, in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip N. Specifically, as illustrated in FIG. 2, the reinforcement member 23 is a plate member that is disposed so as to divide the interior of the metal member 22 into substantially two spaces.

In order to provide the above-described capabilities, the reinforcement member 23 may include metal material having great mechanical strength, such as stainless steel and/or iron. In this exemplary embodiment, the reinforcement member 23 includes, for example, SUS304 (or SUS403) of a thickness of approximately 1.5 mm to approximately 2 mm.

Further, an opposing face of the reinforcement member 23 which faces the heater 25 may include a heat insulation material partially or wholly. Alternatively, the opposing face of the reinforcement member 23 disposed opposite the heater 25 may be mirror-ground. Accordingly, heat radiated by the heater 25 toward the reinforcement member 23 to heat the reinforcement member 23 is used to heat the metal member 22, improving heating efficiency for heating the metal member 22 and the fixing belt 21.

As illustrated in FIG. 2, the pressing roller 31 serves as a rotary pressing member for contacting and pressing against the outer circumferential surface of the fixing belt 21 at the nip N. The pressing roller 31 has an outer diameter of approximately 30 mm. In the pressing roller 31, an elastic layer 33 having a thickness of, for example, approximately 3 mm is provided on a hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip N between the pressing roller 31 and the fixing belt 21.

As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the side plates 43 of the fixing device 20 via the bearings 42, respectively. A heat source, such as a halogen heater, may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the nip N to decrease bending of the metal member 22. Further, the pressing roller 31 provides increased heat insulation, and therefore heat is not transmitted from the fixing belt 21 to the pressing roller 31 easily, improving heating efficiency for heating the fixing belt 21.

In this exemplary embodiment, the diameter of the fixing belt 21 is substantially identical to the diameter of the pressing roller 31. Alternatively, the diameter of the fixing belt 21 is may be smaller than the diameter of the pressing roller 31. In such a case, the curvature of the fixing belt 21 is smaller than the curvature of the pressing roller 31, thus allowing the recording medium P discharged from the nip N to be smoothly separated from the fixing belt 21.

As illustrated in FIG. 4, the inner circumferential surface 21*a* of the fixing belt 21 slides over the stationary member 26. The stationary member 26 includes a surface layer 26*a* disposed on a base layer 26*b*. An opposing face (sliding-contact face) of the stationary member 26 facing the pressing roller 31 has a concave shape of a curvature substantially identical to the curvature of the pressing roller 31. Thus, the recording medium P is discharged from the nip N substantially along the curvature of the pressing roller 31, preventing a failure, such as non-separation of the recording medium P from the fixing belt 21 after the fixing process.

As described above, in this exemplary embodiment, the stationary member 26 forming the nip N has a concave shape. Alternatively, the stationary member 26 may have a flat shape. In other words, the sliding-contact surface of the stationary member 26 that opposes the pressing roller 31 may be formed in flat shape. For such a configuration, the shape of the nip is substantially parallel to an image recorded face of the recording medium P. As a result, the fixing belt 21 comes into closer contact with the recording medium P, thus enhancing fixing performance. In addition, the curvature of the fixing belt 21 is relatively large at the exit side of the nip, thus facilitating smooth separation of the recording medium P from the nip.

The base layer 26*a* of the stationary member 26 includes a rigid material so that the stationary member 26*b* is not bent substantially by pressure applied by the pressing roller 31. In this exemplary embodiment, the base layer 26*b* is made of, for example, aluminum of a thickness of approximately 1.5 mm.

The substantially pipe-shaped metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. A deformed metal member 22 does not provide a desired nip length of the nip N, degrading fixing property. To address this problem, in this exemplary embodiment, the rigid stationary member 26 is provided separately from the thin metal member 22 to help form and maintain the proper nip N.

The surface layer 26*a* of the stationary member 26 is a low friction material such as fluorocarbon rubber. Such a configuration can form a desired nip between the stationary member 26 and the fixing belt 21 while suppressing wear of the fixing belt 21 and the stationary member 26 due to sliding contact of the stationary member 26 with the fixing belt 21. In this exemplary embodiment, the surface layer 26*a* has a thickness of approximately 1.5 and approximately 2 mm.

Further, the surface layer 26*a* may be preliminarily impregnated with the lubricant. Thus, the lubricant is retained at the surface of the stationary member 26 contacting the fixing belt 21, thus suppressing wearing of the stationary member 26 and the fixing belt 21.

As illustrated in FIG. 4, the heat insulator 27 is provided between the stationary member 26 and the heater 25. Specifically, the heat insulator 27 is provided between the stationary member 26 and the metal member 22 in such a manner that the heat insulator 27 covers surfaces of the stationary member 26 other than the sliding surface portion of the stationary member 26 over which the fixing belt 21 slides. The heat insulator 27 includes sponge rubber having desired heat insulation and/or ceramic including air pockets.

In this exemplary embodiment, the metal member 22 is disposed in proximity to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request. In conventional on-demand fixing devices, when heat is applied to the deformed pressing roller 31 at the nip N in the standby mode, the pressing roller 31 may suffer from thermal degradation due to heating of the rubber included in the pressing roller 31, resulting in a shortened life of the pressing roller 31 or permanent compression strain of the pressing roller 31. Heat applied to the deformed rubber increases permanent compression strain of the rubber. The permanent compression strain of the pressing roller 31 makes a dent in a part of the pressing roller 31, and therefore the pressing roller 31 does not provide the desired nip length of the nip N, generating faulting fixing or noise in accordance with rotation of the pressing roller 31.

To address those problems, according to this exemplary embodiment, the heat insulator 27 is provided between the stationary member 26 and the metal member 22 to reduce heat transmitted from the metal member 22 to the stationary member 26 in the standby mode, suppressing heating of the deformed pressing roller 31 at high temperature in the standby mode.

A lubricant is applied between the stationary member 26 and the fixing belt 21 to reduce sliding resistance between the stationary member 26 and the fixing belt 21. However, the lubricant may deteriorate under high pressure and temperature applied at the nip N, resulting in unstable slippage of the fixing belt 21 over the stationary member 26.

To address this problem, according to this exemplary embodiment, the heat insulator 27 is provided between the stationary member 26 and the metal member 22 to reduce heat transmitted from the metal member 22 to the lubricant at the nip N, thus reducing deterioration of the lubricant due to high temperature.

In this exemplary embodiment, the heat insulator 26 provided between the stationary member 26 and the metal member 22 insulates the stationary member 26 from the metal member 22. Accordingly, the metal member 22 heats the fixing belt 21 with reduced heat at the nip N. Consequently, the recording medium P discharged from the nip N has a decreased temperature compared to when the recording medium P enters the nip N. In other words, at the exit of the nip N, the fixed toner image T on the recording medium P has a decreased temperature, and therefore the toner of the fixed toner image T has a decreased viscosity.

Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface opposite an outer circumferential surface facing the heat insulator 27, of a concave portion 22*a* of the metal member 22 into which the stationary member 26 is inserted so as to hold the metal member 22.

In this exemplary embodiment, a stainless steel sheet having a thickness of approximately 0.1 mm is bent into the substantially cylindrical metal member 22. However, spring-back of the stainless steel sheet may expand a circumference of the metal member 22, and therefore the stainless steel sheet may maintain the desired pipe shape. As a result, the metal member 22 having an expanded circumference may contact the inner circumferential surface of the fixing belt 21, damaging the fixing belt 21 or generating temperature fluctuation of the fixing belt 21 due to uneven contact of the metal member 22 to the fixing belt 21.

To address this problem, according to this exemplary embodiment, the stay 28 supports and holds the concave portion (bent portion) 22*a* of the metal member 22 provided with an opening so as to prevent deformation of the metal member 22 due to spring-back. For example, the stay 28 is press-fitted to the concave portion 22*a* of the metal member 22 to contact the inner circumferential surface of the metal member 22 while the shape of the metal member 22 that is bent against spring-back of the stainless steel sheet is maintained.

Preferably, the metal member 22 has a thickness not greater than approximately 0.2 mm to increase heating efficiency of the metal member 22.

As described above, the substantially cylindrical-shaped metal member 22 may be formed by bending sheet metal into the desired shape. Sheet metal is used to give the metal member 22 a thin thickness to shorten warm-up time. However, such a thin metal member 22 has little rigidity, and therefore may be easily bent or deformed by pressure applied by the pressing roller 31. Accordingly, the deformed metal member 22 may not provide a desired nip length of the nip N, resulting in degraded fixing property. To address this problem, according to this exemplary embodiment, the concave portion 22*a* of the thin metal member 22 into which the stationary member 26 is inserted is spaced away from the nip N to prevent the metal member 22 from receiving pressure from the pressing roller 31 directly.

The following describes operation of the fixing device 20 having the above-described structure.

When the image forming apparatus 1 is powered on, power is supplied to the heater 25, and the pressing roller 31 starts rotating in the rotation direction R3. Friction between the pressing roller 31 and the fixing belt 21 rotates the fixing belt 21 in the rotation direction R2. Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 so that the recording medium P enters the nip N formed between the fixing belt 21 and the pressing roller 31 pressed against each other. At the nip N, the fixing belt 21 heated by the heater 25 via the metal member 22 applies heat to the recording medium P. Simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip N is conveyed in a direction Y11.

Below, configuration and operation of a fixing device 20 according to an exemplary embodiment of the present disclosure are described.

Figure 5A:
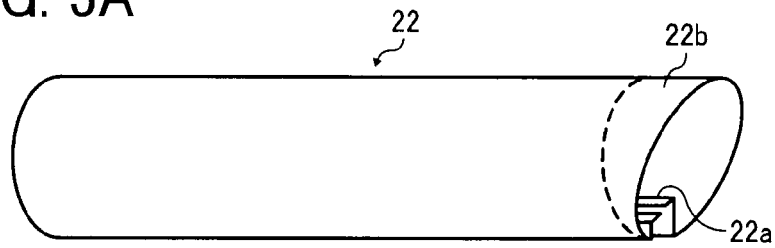
FIG. 5A is a perspective view of a metal member.

As illustrated in FIG. 5A, the fixing device 20 includes a metal member 22 having a protruding portion 22*b* that protrudes axially outward from an axial end of the metal member 22. The protruding portion 22*b* is a portion protruding toward the right side from a dotted line in FIG. 5A.

Figure 5B:
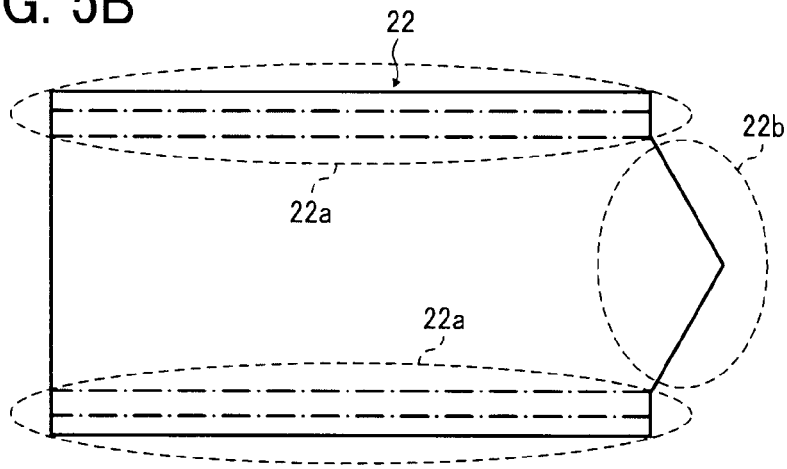
FIG. 5B is a plan view of a pre-bent flat-plate state of the metal member.

For the metal member 22, a flat plate having the protruding portion as illustrated in FIG. 5B is bent into a substantially cylindrical shape. Specifically, a stainless steel plate formed by punching is bent so that end portions thereof in the short direction approach each other. At this time, portions indicated by dashed lines in FIG. 5B are bent in L shape to form a concave portion 22*a*. Thus, as illustrated in FIG. 5A, the substantially-cylindrical metal member 22 has the concave portion 22*a* at the bottom and the protruding portion 22*b* at an axial end thereof.

Figure 6:
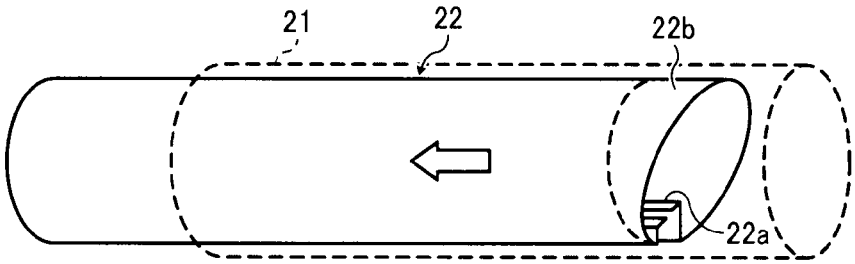
FIG. 6 is a schematic view of a state in which a fixing belt is assembled with the metal member of FIG. 5A.

When the fixing device 20 is manufactured or serviced, as illustrated in FIG. 6, the fixing belt 21 is moved relatively toward the metal member 22 in the axial direction thereof, which is indicated by a blank arrow. Thus, the fixing belt 21 is assembled with the metal member 22. At this time, since the protruding portion 22*b* is provided at an axial end of the metal member 22, the protruding portion 22*b* acts as a guide member to guide the insertion of the fixing belt 21, thus enhancing the operability in assembling the fixing belt 21 with the metal member 22.

Here, as illustrated in FIG. 3, flanges 29 are inserted to both ends of the metal member 22. One of the flanges 29 at the same side as the protruding portion 22*b* includes an escape hole to avoid friction with the protruding portion 22*b*.

Figure 7A:
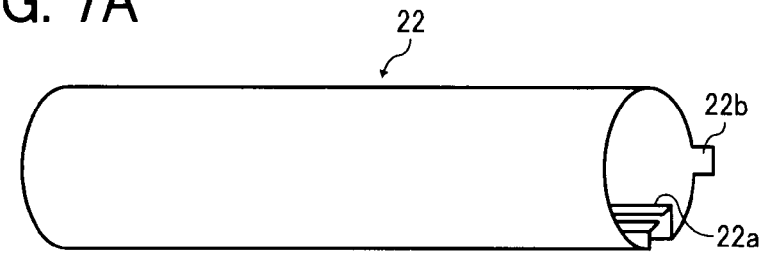
FIG. 7A is a perspective view of a configuration of the metal member.
Figure 7B:
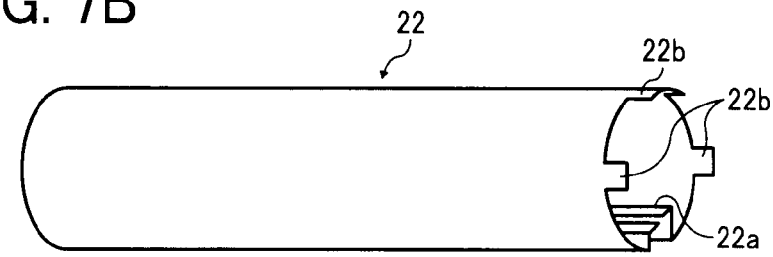
FIG. 7B is a perspective view of another configuration of the metal member.

In this exemplary embodiment, the metal member 22 has one protruding portion 22*b*. However, it is to be noted that the number and shape of the protruding portion 22*b* are not limited to those illustrated in FIG. 5 and may be any suitable number and shape. For example, as illustrated in FIG. 7A, the protruding portion 22*b* of the metal member 22 may be substantially rectangular. Alternatively, as illustrated in FIG. 7B, a plurality of protruding portions 22*b* may be provided at the metal member 22. Further, as illustrated in FIG. 7B, the protruding portions 22*b* may be triangular.

As described above, in this exemplary embodiment, the protruding portion(s) 22*b* is (are) provided at an axial end of the metal member 22 so as to protrude axially outward from the axial end of the metal member 22 when the fixing belt 21 is assembled with the metal member 22. Such a configuration can enhance the operability in assembling the fixing belt 21 with the metal member 22 while preventing a fixing failure even when the fixing device 20 operates at high speed with a shortened warm-up time and/or first print time.

Next, an exemplary embodiment of the present disclosure is described with reference to FIG. 8.

Figure 8:
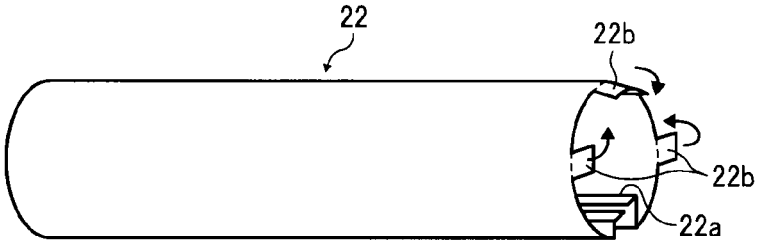
FIG. 8 is a perspective view of a metal member in an exemplary embodiment.

FIG. 8 is a perspective view of a metal member 22 in this exemplary embodiment. For the metal member 22 illustrated in FIG. 8, protruding portions 22*b* are folded toward the inner circumferential surface side of the metal member 22 when a fixing belt 21 is assembled with the metal member 22, which differs from the metal member 22 illustrated in FIG. 5A.

As with the above-described exemplary embodiment, the fixing device 20 according to this exemplary embodiment also includes a fixing belt 21 serving as a belt member, a stationary member 26, a metal member 22 of a substantially cylindrical shape, a reinforcement member 23, a heater 25 serving as a heat source, a pressing roller 31 serving as a rotary pressing member, and a temperature sensor 40. Further, the metal member 22 includes the protruding portions 22*b* at an axial end of the metal member 22.

Figure 7C:
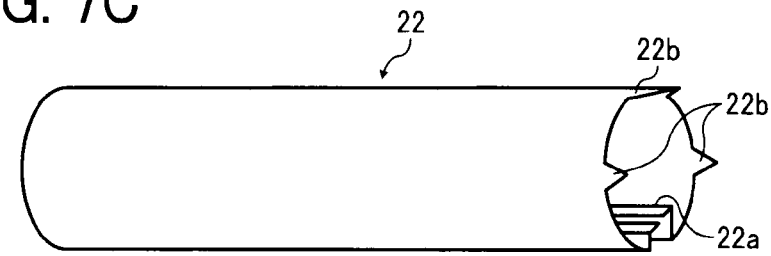
FIG. 7C is a perspective view of still another configuration of the metal member.

As illustrated in FIG. 8, the protruding portions 22*b* are folded inward from the axial direction of the metal member 22 toward the inner circumferential surface side of the metal member 22 at an angle of 90 degrees or less. Specifically, for the metal member 22 illustrated in FIG. 8, each of the three protruding portions 22*b* is folded slightly inward as compared to the metal member 22 illustrated in FIG. 7.

When the fixing device 20 is manufactured or serviced, the fixing belt 21 is relatively moved toward the metal member 22, so that the fixing belt 21 is assembled with the metal member 22. At this time, the protruding portions 22*b* at the axial end of the metal member 22 are folded slightly inward, thus preventing the protruding portions 22*b* from hooking on to the fixing belt 21 when the fixing belt 21 is relatively moved toward the metal member 22 for assembly. Thus, the operability in assembling the fixing belt 21 with the metal member 22 can be further enhanced.

As described above, as with the above-described exemplary embodiment, the metal member 22 in this exemplary embodiment is also provided with the protruding portions 22*b* at an axial end thereof. The protruding portions 22*b* are provided so as to protrude axially outward from the axial end of the metal member 22 when the fixing belt 21 is assembled with the metal member 22. Such a configuration can enhance the operability in assembling the fixing belt 21 with the metal member 22 while preventing a fixing failure even when the fixing device 20 operates at high speed with a shortened warm-up time and/or first print time.

Next, an exemplary embodiment of the present disclosure is described with reference to FIGS. 9 and 10.

Figure 9:
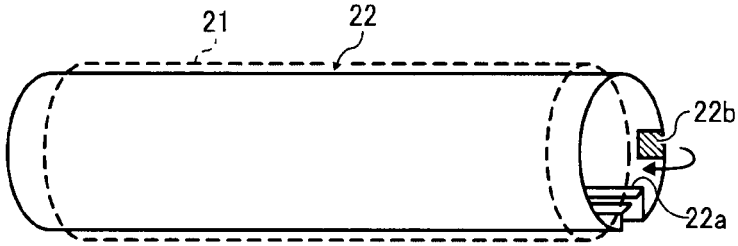
FIG. 9 is a perspective view illustrating an assembled state of a metal member in an exemplary embodiment.

FIG. 9 is a perspective view illustrating an assembled state of a metal member. FIG. 10 is a side view illustrating an assembled state of another configuration of the metal member.

Figure 10:
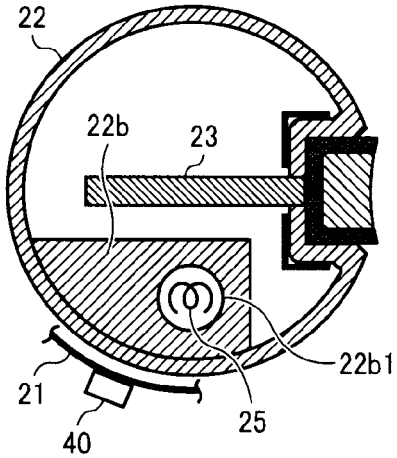
FIG. 10 is a side view illustrating an assembled state of another configuration of the metal member.

For the metal member 22 illustrated in each of FIGS. 9 and 10, a protruding portion 22*b* protruding axially outward from an axial end of the metal member 22 is folded axially inward toward the inner circumferential surface side of the metal member 22 after a fixing belt 21 is assembled with the metal member 22, which differs from the metal member 22 illustrated in FIG. 5A.

As with the above-described embodiments, the fixing device 20 illustrated in each of FIGS. 9 and 10 also includes a fixing belt 21 serving as a belt member, a stationary member 26, a metal member 22 of a substantially cylindrical shape, a reinforcement member 23, a heater 25 serving as a heat source, a pressing roller 31 serving as a rotary pressing member, a temperature sensor 40, an insulator member 27, and a stay member 28. Further, as illustrated in FIG. 7A, the metal member 22 manufactured includes the protruding portion 22*b* at an axial end of the metal member 22. With the protruding portion 22*b* being acted as the guide member, the fixing belt 21 is relatively moved toward the metal member 22, so that the fixing belt 21 is assembled with the metal member 22. Thus, the operability in assembling the fixing belt 21 with the metal member 22 can be enhanced.

As described above, the protruding portion 22*b* is provided to enhance the operability in assembly. Therefore, after assembly, the protruding portion 22*b* is not necessary in fixing process unless, for example, servicing is performed. Therefore, it is sufficient that the metal member 22*b* includes the protruding portion 22*b* at least in assembly (i.e., when the fixing belt 21 is relatively moved toward the metal member 22 in the axial direction of the metal member 22 for assembly). Hence, the metal member 22 illustrated in FIG. 9 is folded in proximity to the inner circumferential surface of the metal member 22 after the fixing belt 21 is assembled with the metal member 22. Such a configuration can prevent an increase in the axial size of the fixing device 20 caused by providing the protruding portion 22*b* or friction of the protruding portion 22*b* against other components.

Since the metal member 22 is thin, an operator can easily fold the protruding portion 22*b* in manual fashion without substantially deforming its neighboring portion.

In this exemplary embodiment, after the fixing belt 21 is assembled with the metal member 22, the protruding portion 22*b* is folded approximately 180 degrees so as to be in proximity to the inner circumferential surface of the metal member 22.

By contrast, as illustrated in FIG. 10, after the fixing belt 21 is assembled with the metal member 22, the protruding portion 22*b* may be folded approximately 90 degrees so as to cover a portion of an opening of the axial end of the metal member 22. For example, as illustrated in FIG. 10, in a case in which the protruding portion 22*b* is folded so as to cover an installed area of the heater 25, the protruding portion 22*b* acts as a reflection plate that reflects heat of the heater 25 inward without radiating it to the outside, thus enhancing the heating efficiency of the metal member 22. In FIG. 10, the protruding portion 22*b* includes a hole 22*b*1 through which the heater 25 is installed to or taken out from the metal member 22 (the fixing device 20).

As described above, as with the above-described exemplary embodiments, the metal member 22 in this exemplary embodiment is also provided with the protruding portion 22*b* at the axial end thereof. The protruding portion 22*b* is provided so as to protrude from the axial end of the metal member 22 to the outside when the fixing belt 21 is assembled with the metal member 22. Such a configuration can enhance the operability in assembling the fixing belt 21 with the metal member 22 while preventing a fixing failure even when the fixing device 20 operates at high speed with a shortened warm-up time and/or first print time.

Next, an exemplary embodiment of the present disclosure is described with reference to FIGS. 11A to 11D.

Figure 11A:
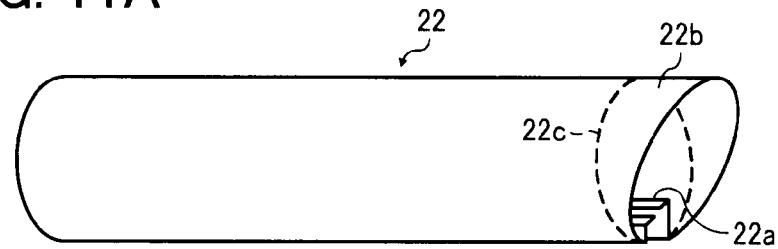
FIG. 11A is a perspective view illustrating an in-assembly state of a metal member in an exemplary embodiment.
Figure 11B:
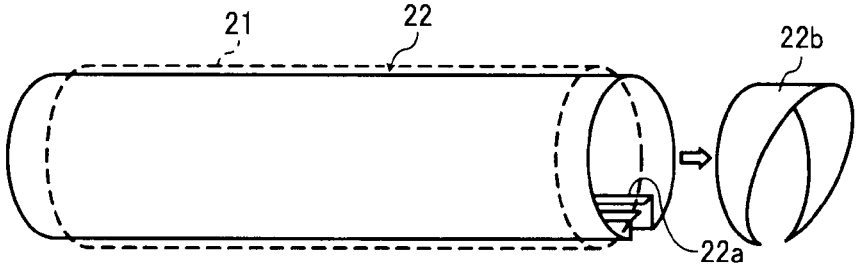
FIG. 11B is a perspective view illustrating an assembled state of the metal member.
Figure 11C:
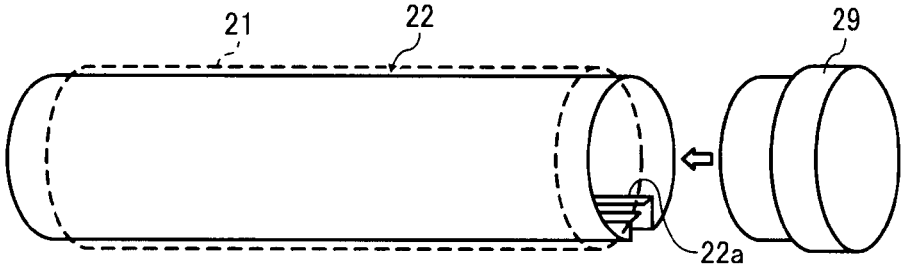
FIG. 11C is a perspective view illustrating a state in which a flange is inserted to an end of the metal member after assembly.
Figure 11D:
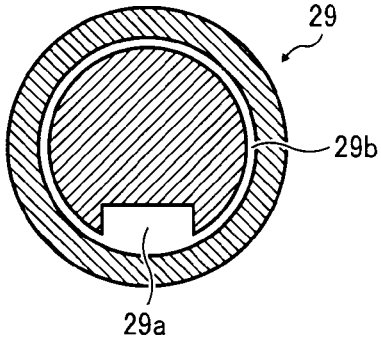
FIG. 11D is a front view of the flange of FIG. 11C.

FIG. 11A is a perspective view illustrating an in-assembly state of a metal member 22 in this exemplary embodiment. FIG. 11B is a perspective view illustrating an assembled state of the metal member 22. FIG. 11C is a perspective view illustrating a state in which a flange 29 is inserted to an end of the metal member 22 after assembly. FIG. 11D is a front view of the flange 29.

For the metal member 22 in this exemplary embodiment, a protruding portion 22*b* protruding from an axial end of the metal member 22 during assembly is cut from the metal member 22 after assembly, which differs from the metal member 22 illustrated in FIG. 5A.

As with the above-described embodiments, the fixing device 20 in this exemplary embodiment also includes a fixing belt 21 serving as a belt member, a stationary member 26, a metal member 22 of a substantially cylindrical shape, a reinforcement member 23, a heater 25 serving as a heat source, a pressing roller 31 serving as a rotary pressing member, a temperature sensor 40, an insulator member 27, and a stay member 28. Further, as illustrated in FIG. 11A, the metal member 22*b* in assembly (after manufacturing) includes the protruding portion 22*b* at an axial end of the metal member 22. With the protruding portion 22*b* being acted as a guide member, the fixing belt 21 is relatively moved toward the metal member 22, so that the fixing belt 21 is assembled with the metal member 22. Thus, the operability in assembling the fixing belt 21 with the metal member 22 can be enhanced.

As described above, the protruding portion 22*b* is provided to enhance the operability in assembly. Therefore, after assembly, the protruding portion 22*b* is not necessary in fixing process unless, for example, servicing is performed. Accordingly, it is sufficient that the metal member 22*b* includes the protruding portion 22*b* at least in assembly (i.e., when the fixing belt 21 is relatively moved toward the metal member 22 in the axial direction of the metal member 22 for assembly).

Hence, as illustrated in FIG. 11B, the metal member 22 in this exemplary embodiment is cut from the metal member 22 after the fixing belt 21 is assembled with the metal member 22. Such a configuration can prevent an increase in the axial size of the fixing device 20 caused by providing the protruding portion 22*b* or friction of the protruding portion 22*b* against other components.

As illustrated in FIG. 11A, a border of the protruding portion 22*b* has perforation holes 22*c* formed by punching a pre-bent flat plate. Accordingly, an operator can easily cut the protruding portion 22*b* with, for example, a cutter. In addition, since the metal member 22 is thin, the operator can also cut the protruding portion 22*b* without substantially deforming its neighboring portion.

As illustrated in FIG. 11C, after the protruding portion 22*b* is removed, the flange 29 is inserted to each end of the metal member 22 assembled with the fixing belt 21. As illustrated in FIG. 11D, the flange 29 at the same side as the protruding portion 22*b* includes a first groove 29*a* to avoid friction with the concave portion 22*a* of the metal member 22 and a second groove 29*b* to avoid friction with burrs of a cut surface of the metal member 22.

As described above, as with the above-described exemplary embodiments, the metal member 22 in this exemplary embodiment is also provided with the protruding portion 22*b* at an axial end thereof. The protruding portion 22 is provided so as to protrude axially outward from the axial end of the metal member 22 when the fixing belt 21 is assembled with the metal member 22. Such a configuration can enhance the operability in assembly the fixing belt 21 with the metal member 22 while preventing a fixing failure even when the fixing device 20 operates at high speed with a shortened warm-up time and/or first print time.

Next, an exemplary embodiment of the present disclosure is described with reference to FIG. 12.

Figure 12:
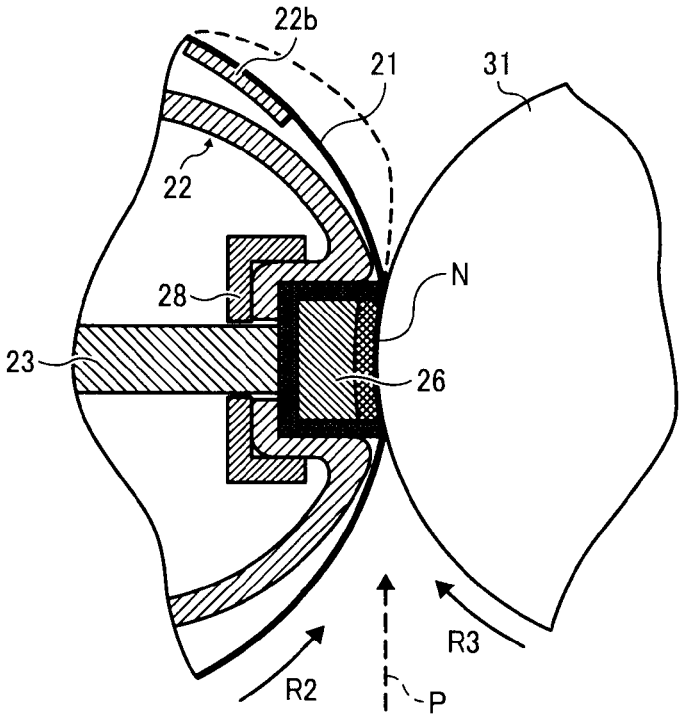
FIG. 12 is an enlarged sectional view of a nip and its neighboring area of a fixing device according to an exemplary embodiment.

FIG. 12 is an enlarged sectional view of a nip and its neighboring area of a fixing device 20 according to this exemplary embodiment. For the metal member 22 illustrated in FIG. 12, a protruding portion 22*b* protruding from an axial end of the metal member 22 during assembly is folded toward the outer circumferential surface side of the metal member 22 after assembly, which differs from the metal member 22 illustrated in FIG. 5A.

As with the above-described embodiments, the fixing device 20 in this exemplary embodiment also includes a fixing belt 21 serving as a belt member, a stationary member 26, a metal member 22 of a substantially cylindrical shape, a reinforcement member 23, a heater 25 serving as a heat source, a pressing roller 31 serving as a rotary pressing member, a temperature sensor 40, an insulator member 27, and a stay member 28. Further, as illustrated in FIG. 7A, the metal member 22 in assembly (after manufacturing) includes the protruding portion 22*b* at an axial end of the metal member 22. With the protruding portion 22*b* being acted as the guide member, the fixing belt 21 is relatively moved toward the metal member 22, so that the fixing belt 21 is assembled with the metal member 22. Thus, the operability in assembling the fixing belt 21 with the metal member 22 can be enhanced.

As illustrated in FIG. 12, for the fixing device 20 in this exemplary embodiment, since the fixing belt 21 is more tense at an area upstream from the nip in a rotation direction of the fixing belt 21, the fixing belt 21 might slack at an area downstream from the nip (for example, follows a trajectory as indicated by a dotted line in FIG. 12). If such a slack of the fixing belt 21 increase, a fixed image on a recording media P discharged from the nip may be offset or subject to other failures, or result in a reduced separation performance of the recording medium P discharged from the nip.

Hence, the metal member 22 illustrated in FIG. 12 has the protruding portion 22*b* at a position downstream from the nip in the rotation direction of the fixing belt 21, and after assembly, the protruding portion 22*b* is folded so as to be in proximity to the outer circumferential surface of the metal member 22 between the fixing belt 21 and the metal member 22, which is a state illustrated in FIG. 12.

Specifically, the protruding portion 22*b* protrudes axially outward from an axial end of the metal member 22 in assembly, and is folded, after assembly, toward the outer circumferential surface side of the metal member 22 to apply tension to the fixing belt 21 at the position downstream from the nip. Such a configuration can prevent the above-described slack of the fixing belt 21 at an area downstream from the nip. Accordingly, such a configuration can prevent offset of a fixed image on a recording media P discharged from the nip or a reduced separation performance of the recording medium P discharged from the nip.

In this exemplary embodiment, it is preferable to provide the protruding portion 22*b* at each axial end of the metal member 22 and, after assembly, fold the protruding portion 22*b* at each axial end. Such a configuration can suppress the above-described slack of the fixing belt 21 at an area downstream from the nip in a well-balanced manner.

As described above, as with the above-described exemplary embodiments, the metal member 22 in this exemplary embodiment is also provided with the protruding portion 22*b* at an axial end thereof. The protruding portion 22*b* is provided so as to protrude axially outward from the axial end of the metal member 22 when the fixing belt 21 is assembled with the metal member 22. Such a configuration can enhance the operability in assembling the fixing belt 21 with the metal member 22 while preventing a fixing failure even when the fixing device 20 operates at high speed with a shortened warm-up time and/or first print time.

Next, an exemplary embodiment of the present disclosure is described with reference to FIG. 13.

Figure 13:
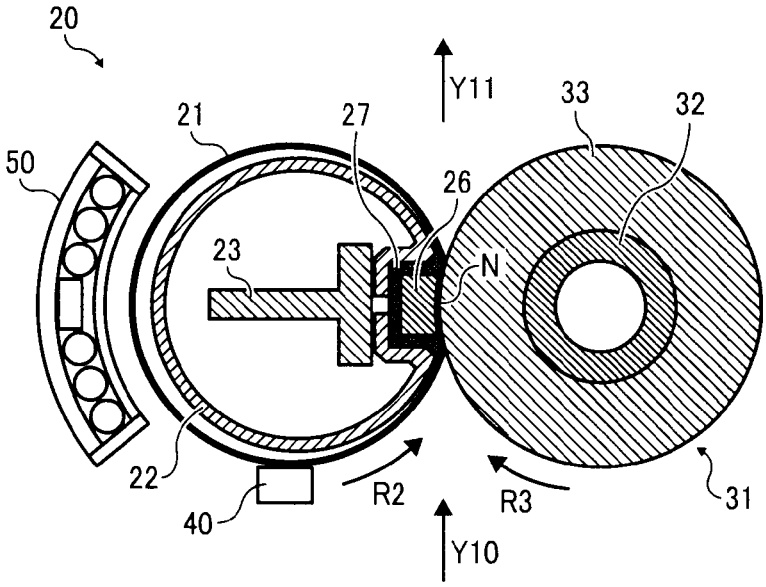
FIG. 13 is a sectional view of a fixing device according to an exemplary embodiment of the present disclosure.

FIG. 13 is a perspective view of a fixing device 20 in this exemplary embodiment. For the fixing device 20 illustrated in FIG. 13, the metal member 22 is heated by electromagnetic induction, which differs from the fixing device illustrated in 5A.

As with the fixing device 20 illustrated in FIG. 2, the fixing device 20 illustrated in FIG. 13 also includes a fixing belt 21 serving as a belt member, a stationary member 26, a metal member 22 of a substantially cylindrical shape, a reinforcement member 23, a heat insulator 27, a pressing roller 31 serving as a rotary pressing member, and a temperature sensor 40. Further, as with the fixing device 20 illustrated in FIG. 5A, the metal member 22 according to this exemplary embodiment also includes a protruding portion 22*b* at an axial end of the metal member 22. With the protruding portion 22*b* being acted as the guide member, the fixing belt 21 is relatively moved toward the metal member 22 in the axial direction thereof, so that the fixing belt 21 is assembled with the metal member 22. Thus, the operability in assembling the fixing belt 21 with the metal member 22 can be enhanced.

The fixing device 20 includes an induction heater 50 as a heating unit, instead of the heater 25 illustrated in FIG. 2. In the above-described fixing device 20 illustrated in FIG. 2, radiation heat generated by the heater 25 heats the metal member 22. By contrast, in the fixing device 20 illustrated in FIG. 13, the induction heater 50 heats the metal member 22 by electromagnetic induction.

The induction heater 50 includes an exciting coil, a core, and a coil guide. The exciting coil includes litz wires formed of a bundle of thin wires, which extend in the axial direction of the fixing belt 21 (e.g., a direction perpendicular to a surface of a sheet on which FIG. 13 is printed) to cover a part of the fixing belt 21. The coil guide includes heat-resistant resin and holds the exciting coil and the core. The core is a semi-cylindrical member including a ferromagnet having a relative magnetic permeability in a range of from approximately 1,000 to approximately 3,000, such as ferrite. The core includes a center core and a side core to generate magnetic fluxes toward the metal member 22 effectively. The core is disposed opposite the exciting coil extending in the axial direction of the fixing belt 21.

Operation of the fixing device 20 having the above-described structure is described below. The induction heater 50 heats the fixing belt 21 rotating in the rotation direction R2 at a position at which the fixing belt 21 faces the induction heater 50. Specifically, a high-frequency alternating current is applied to the exciting coil to generate magnetic lines of force around the metal member 22 in such a manner that the magnetic lines of force are alternately switched back and forth. Accordingly, an eddy current is generated on the surface of the metal member 22, and electric resistance of the metal member 22 generates Joule heat. The Joule heat heats the metal member 22 by electromagnetic induction, and the heated heating member 22 heats the fixing belt 21.

In order to heat the metal member 22 effectively by electromagnetic induction, the induction heater 50 may face the metal member 22 in an entire circumferential direction of the metal member 22. The metal member 22 may include nickel, stainless steel, iron, copper, cobalt, chrome, aluminum, gold, platinum, silver, tin, palladium, and/or an alloy of a plurality of those metals, or the like.

As described above, as with the above-described exemplary embodiments, the metal member 22 in this exemplary embodiment is also provided with the protruding portion 22*b* at an axial end thereof. The protruding portion 22*b* is provided so as to protrude axially outward from the axial end of the metal member 22 when the fixing belt 21 is assembled with the metal member 22. Such a configuration can enhance the operability in assembling the fixing belt 21 with the metal member 22 while preventing a fixing failure even when the fixing device 20 operates at high speed with a shortened warm-up time and/or first print time.

As described above, for the fixing device 20 illustrated in FIG. 12, the induction heater 50 heats the metal member 22 by electromagnetic induction. Alternatively, a resistance heat generator may heat the metal member 22. For example, the resistance heat generator may contact an inner circumferential surface of the metal member 22 partially or wholly. The resistance heat generator may be a sheet-type heat generator such as a ceramic heater, and a power source may be connected to both ends of the resistance heat generator. When an electric current is applied to the resistance heat generator, electric resistance of the resistance heat generator increases the temperature of the resistance heat generator. Accordingly, the resistance heat generator heats the metal member 22 contacted by the resistance heat generator. Consequently, the heated metal member 22 heats the fixing belt 21. In such a configuration, the protruding portion 22*b* is also provided at an axial end of the metal member 22, thus obtaining effects equivalent to the effects obtained by the fixing device 20 described above.

In each of the above-described exemplary embodiments, a fixing belt having the multi-layer structure is used as the fixing belt 21. Alternatively, an endless fixing film including polyimide, polyamide, fluorocarbon resin, and/or metal may be used as a fixing belt to provide effects equivalent to the effects provided by the fixing device 20 described above.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. The number, positions, and shapes of the above-described components are not limited to those described in each of the above-described exemplary embodiments and may be any other number, position, and shape suitable for practicing the present disclosure.

What is claimed is:

1. A fixing device comprising:

a metal member that is substantially cylindrical;

a heater positioned to heat the metal member;

a fixing member that is endless and flexible, and disposed rotatably around the metal member, an inner circumferential surface of the fixing member being heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes; and a stationary member disposed at an inner circumferential surface side of the fixing member and pressed by the rotary pressing member via the fixing member to form the nip, wherein, at least when the fixing member is relatively moved toward the metal member during assembly of the fixing member with the metal member, the metal member includes at least one protruding portion having a length less than a length of an axial end of the metal member in a rotation direction of the fixing member around the metal member, and the at least one protruding portion protrudes axially outward from the axial end of the metal member to guide the fixing member axially toward the metal member.

2. The fixing device according to claim 1, wherein, at least when the fixing member is relatively moved toward the metal member during assembly of the fixing member with the metal member, the at least one protruding portion is folded axially inward toward an inner circumferential surface side of the metal member at an angle of 90 degrees or less.

3. The fixing device according to claim 1, wherein, after assembly of the fixing member with the metal member, the at least one protruding portion is folded axially inward toward an inner circumferential surface side of the metal member to be in proximity to the inner circumferential surface of the metal member.

4. The fixing device according to claim 1, wherein, after assembly of the fixing member with the metal member, the at least one protruding portion is folded axially inward to cover a portion of an opening in the axial end of the metal member.

5. The fixing device according to claim 1, wherein, after assembly of the fixing member with the metal member, the at least one protruding portion is capable of being removed from the metal member.

6. The fixing device according to claim 1, wherein the at least one protruding portion is disposed downstream from the nip in the rotation direction of the fixing member and, after assembly of the fixing member with the metal member, folded toward an outer circumferential surface of the metal member between the inner circumferential surface of the fixing member and the outer circumferential surface of the metal member.

7. The fixing device according to claim 1, wherein the metal member is sheet metal formed into a substantially cylindrical shape, and wherein the sheet metal includes an axial end provided with the at least one protruding portion.

8. The fixing device according to claim 1, further comprising a reinforcement member fixedly disposed within the metal member in contact with the stationary member to reinforce the stationary member.

9. An image forming apparatus comprising a fixing device, the fixing device comprising:

a metal member that is substantially cylindrical;

a heater positioned to heat the metal member;

a fixing member that is endless and flexible, and disposed rotatably around the metal member, an inner circumferential surface of the fixing member being heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes; and a stationary member disposed at an inner circumferential surface side of the fixing member and pressed by the rotary pressing member via the fixing member to form the nip, wherein, at least when the fixing member is relatively moved toward the metal member during assembly of the fixing member with the metal member, the metal member includes at least one protruding portion having a length less than a length of an axial end of the metal member in a rotation direction of the fixing member around the metal member, and the at least one protruding portion protrudes axially outward from the axial end of the metal member to guide the fixing member axially toward the metal member.

10. A fixing device comprising:

a metal member that is substantially cylindrical;

a heater positioned to heat the metal member;

a fixing member that is endless and flexible, and disposed rotatably around the metal member, an inner circumferential surface of the fixing member being heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes; and a stationary member disposed at an inner circumferential surface side of the fixing member and pressed by the rotary pressing member via the fixing member to form the nip, wherein, at least when the fixing member is relatively moved toward the metal member during assembly of the fixing member with the metal member, the metal member includes at least one protruding portion protruding axially outward from an axial end of the metal member to guide the fixing member axially toward the metal member, and wherein, after assembly of the fixing member with the metal member, the at least one protruding portion is removed from the metal member.

11. A fixing device comprising:

a metal member that is substantially cylindrical;

a heater positioned to heat the metal member;

a fixing member that is endless and flexible, and disposed rotatably around the metal member, an inner circumferential surface of the fixing member being heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes; and a stationary member disposed at an inner circumferential surface side of the fixing member and pressed by the rotary pressing member via the fixing member to form the nip, wherein, at least when the fixing member is relatively moved toward the metal member during assembly of the fixing member with the metal member, the metal member includes at least one protruding portion protruding axially outward from an axial end of the metal member to guide the fixing member axially toward the metal member, and wherein the at least one protruding portion is disposed downstream from the nip in a rotation direction of the fixing member and, after assembly of the fixing member with the metal member, folded toward an outer circumferential surface of the metal member between the inner circumferential surface of the fixing member and the outer circumferential surface of the metal member.

* * * * *